US006390907B1

(12) United States Patent
Metzler et al.

(10) Patent No.: US 6,390,907 B1
(45) Date of Patent: May 21, 2002

(54) MACHINE TOOL AND MACHINE TOOL SPINDLE AND WORKPIECE MOUNTING-APPARATUS AND GRINDING PROCESS

(76) Inventors: Joel Kym Metzler, 786 Leitersburg Rd., Greencastle, PA (US) 17225; William Wood Pflager, 133 Myrtle Ave., Waynesboro, PA (US) 17268

( * ) Notice: Subject to any disclaimer, the term of this patent is extended or adjusted under 35 U.S.C. 154(b) by 281 days.

(21) Appl. No.: 09/020,732

(22) Filed: Feb. 9, 1998

(51) Int. Cl.[7] ..... B24B 23/00; B24B 27/08

(52) U.S. Cl. ..... 451/360; 451/363; 451/294; 451/62; 451/251

(58) Field of Search ..... 451/360, 363, 451/294, 62, 251

(56) References Cited

U.S. PATENT DOCUMENTS 4,006,944 A * 2/1977 Ando et al. ..... 308/187
4,037,496 A * 7/1977 Gerth ..... 82/28 R
4,432,245 A * 2/1984 Hattori et al. ..... 73/862.32
4,851,752 A * 7/1989 Nishimura ..... 318/602
4,897,851 A * 1/1990 Vecht et al. ..... 372/107
4,928,561 A * 5/1990 Fouche ..... 82/1.11
4,934,040 A * 6/1990 Turchan ..... 29/566
4,976,177 A * 12/1990 Fouche ..... 82/147
5,027,280 A * 6/1991 Ando et al. ..... 364/474.16
5,220,749 A * 6/1993 Youden et al. ..... 51/3
5,274,286 A * 12/1993 Yamamura ..... 310/67 R
5,443,413 A * 8/1995 Pflager et al. ..... 451/11
5,772,564 A * 6/1998 Taniguchi et al. ..... 483/7

* cited by examiner

*Primary Examiner*—Allen Ostrager
*Assistant Examiner*—William Hong

(57) ABSTRACT

A motorized spindle assembly for a grinding wheel is fabricated with an opening extending through the spindle casing, and stator and so as to extend in the direction of the spindle axis of rotation at least the length of the stator. The opening is of a size, depth, configuration and disposition so that when the spindle assembly is utilized to grind a workpiece and to do so is moved towards the workpiece, that portions of the workpiece are received within the opening thus permitting the spindle assembly and its grinding wheel to be moved as close as possible to the workpiece axis of rotation. The motorized spindle assembly is carried by a wheelhead for coaction with an additional spindle assembly carrying a grinding wheel with a larger radius. The larger radius grinding wheel is utilized to rough grind cam lobes and the smaller grinding wheel is utilized to finish grind the cam lobes and to grind concave cam contours for the cam lobes.

11 Claims, 6 Drawing Sheets

MACHINE TOOL AND MACHINE TOOL SPINDLE AND WORKPIECE MOUNTING-APPARATUS AND GRINDING PROCESS

BACKGROUND OF THE INVENTION-FIELD OF APPLICATION

This invention relates to machine tools and grinding processes; and, more particularly, to machine tools, wheel heads, tool drive spindles, workpiece mounting and grinding processes for grinding cam lobes on cam shafts.

BACKGROUND OF THE INVENTION-DESCRIPTION OF THE PRIOR ART

Many machine tools such as, for example, grinding machines, of the type shown in FIG. 1, mount a workpiece 3 for rotation between a headstock 5 and a footstock 7 which are, in turn, both mounted, in conventional manner, on a workpiece carriage 9 that is itself carried by the machine tool frame or bed 15 for reciprocating movement in the directions of arrows A and B along a workpiece axis of rotation "X". The machine tool cutting tool, which may be a grinding wheel 31, is rotatively carried by a tool carriage 33 that reciprocates in the directions of arrows R and S on the machine tool frame or bed 15 in directions perpendicular to the workpiece axis of rotation "X". Thus grinding wheel 31 is moved towards and into the workpiece 3 to grind the workpiece 3, or selected parts of the workpiece; and away from the workpiece 3 to permit relocation or indexing of the workpiece 3 to grind another part or portion thereof.

Generally speaking the diameter of the grinding wheel 31 is selected to be large enough so that carriage 33 and the grinding wheel 31 may be moved in the direction of arrow R a sufficient distance to grind the smallest required radial dimension for cam lobe 35; while leaving an appropriate distance between an outer surface 41 of housing, or spindle casing, 43 of tool spindle 45 and the outer surfaces of cam lobes 35. The sizing and disposition of the drive motor 47 for tool spindle 45 are also selected so that there is an appropriate spacing between motor 47 and footstock 7 when motor 47 moves with carriage 33 and tool spindle 45 in the direction of arrow R to its closest possible position to footstock 7 and cam lobes 35.

Problems, however, have been encountered with available machine tools and grinding machines when relatively small grinding wheels must be utilized to grind discrete parts, such as cam lobes 35 on cam shafts 37; and especially where re-entrant or concave cam surfaces (such as surface 61—FIG. 2—of cam lobe 63 of cam 65) are to be ground. Available constructions for spindle 45 (FIG. 1), for rotating the tool such as grinding wheel 31, and for the housing 43 enclosing such spindles 41, place a practical limit on how close the spindles' axis of rotation "y" can be moved in the direction of arrow R, towards the workpiece axis of rotation "x" and how close the outer surfaces of the housings or casings for such tool spindles and their drive motors can be moved towards the rotating cam lobes 35.

U.S. Pat. No. 5,697,831 patented on Dec. 16, 1997, to F. Retchel for "Machine Tool With Plural Tool Spindles" provides a grinding machine with dual spindles each mounting a different size grinding wheel. The drive for each such spindle is shown and described as a belt drive to the spindle from a motor that is spaced from the spindle. However, belt drives have been found undesirable for spindle speeds demanded for today's grinding processes. To mount a conventional motor in-line with the spindle and relatively close to the grinding wheel, could create a mechanism where the motor, moving with the spindle, would interfere with and limit the travel of smaller grinding wheel towards the workpiece and thus the ability to properly grind concave surfaces. To provide an in-line motor for the spindle that is spaced from the grinding wheel would provide unacceptably long spindle shafts affecting grinding accuracy.

SUMMARY OF THE INVENTION

It is therefore an object of this invention to provide a new and novel machine tool.

It is another object of this invention to provide a new and novel grinding machine.

It is yet another object of this invention to provide a new and novel machine tool for grinding parts with at least some portion thereof concave in relationship to other portions of the surface of such parts.

It is still another object of this invention to provide a new and novel grinding machine for grinding cam lobes.

It is yet still another object of this invention to provide a new and novel grinding machine for grinding cam lobes with re-entrant curves.

It is a further object of this invention to provide a new and novel grinding process.

It is yet a further object of this invention to provide a new and novel grinding process for parts with concave surface configurations.

It is yet still a further object of this invention to provide a new and novel process for grinding cam lobes which include re-entrant or concave cam surface portions.

It is still a further object of this invention to provide a new and novel tool spindle.

It is still a further object of this invention to provide a new and novel tool spindle for a grinding machine.

It is yet still a further object of this invention to provide a new and novel grinding machine with a pair of tool spindles.

It is yet still a further object of this invention to provide a new and novel grinding machine with a first tool spindle for one or more relatively large diameter grinding wheels and a second tool spindle for relatively small diameter grinding wheels.

It is yet still a further object of this invention to provide a new and novel cam lobe grinding apparatus and process for grinding cam lobes with re-entrant or concave cam surface portions as well as convex cam surface portions.

Other objects, features and advantages of the invention in its details of construction and arrangement of parts will be seen from the above and from the following description of the preferred embodiments when considered with the drawing and from the appended claims.

DESCRIPTION OF THE PREFERRED EMBODIMENTS

Figure 3:
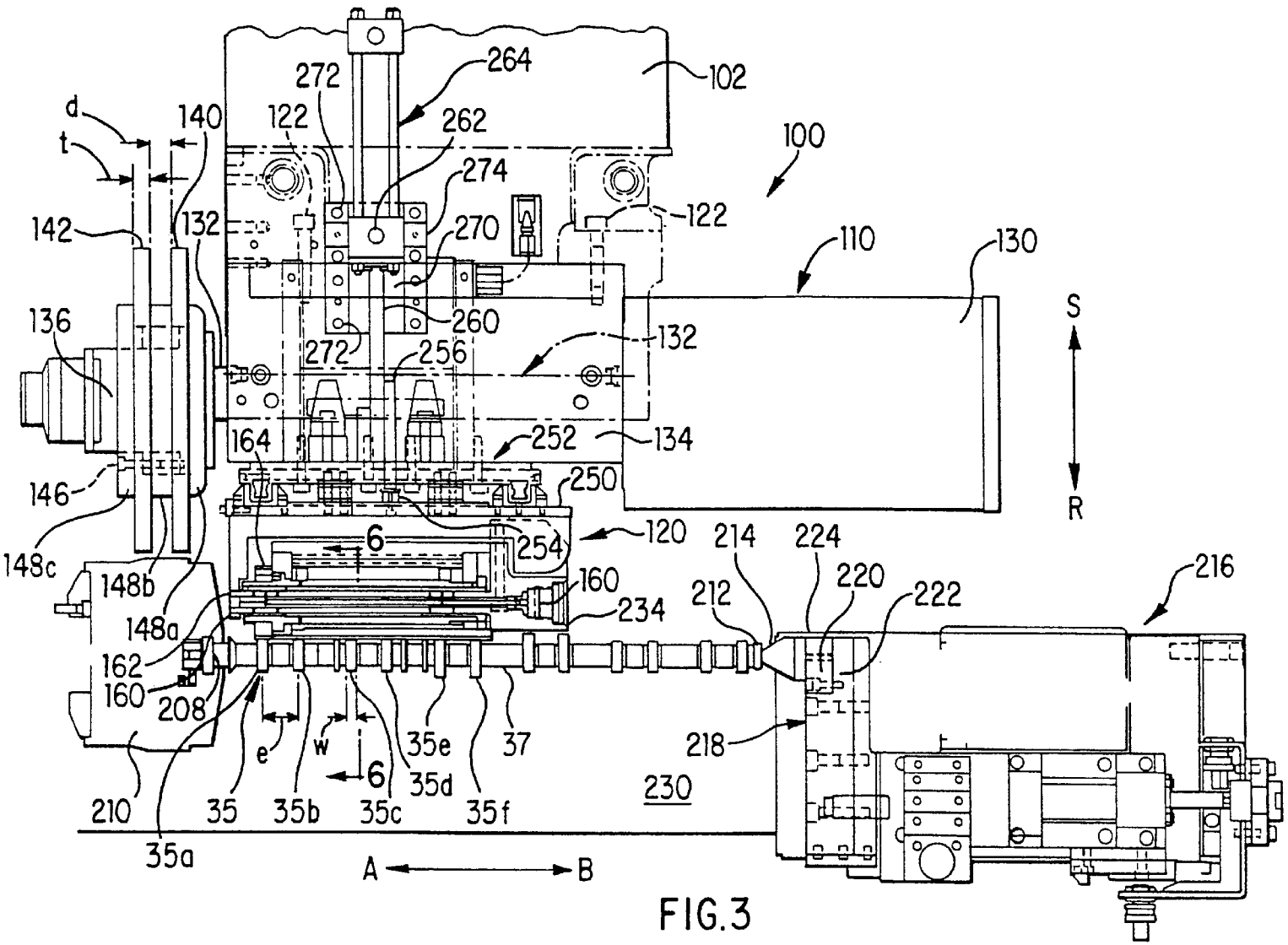
FIG. 3 is a section view of a wheel head and tool spindle arrangement with respect to a workpiece rotatively mounted between a headstock and footstock, all incorporating the instant invention.
Figure 4:
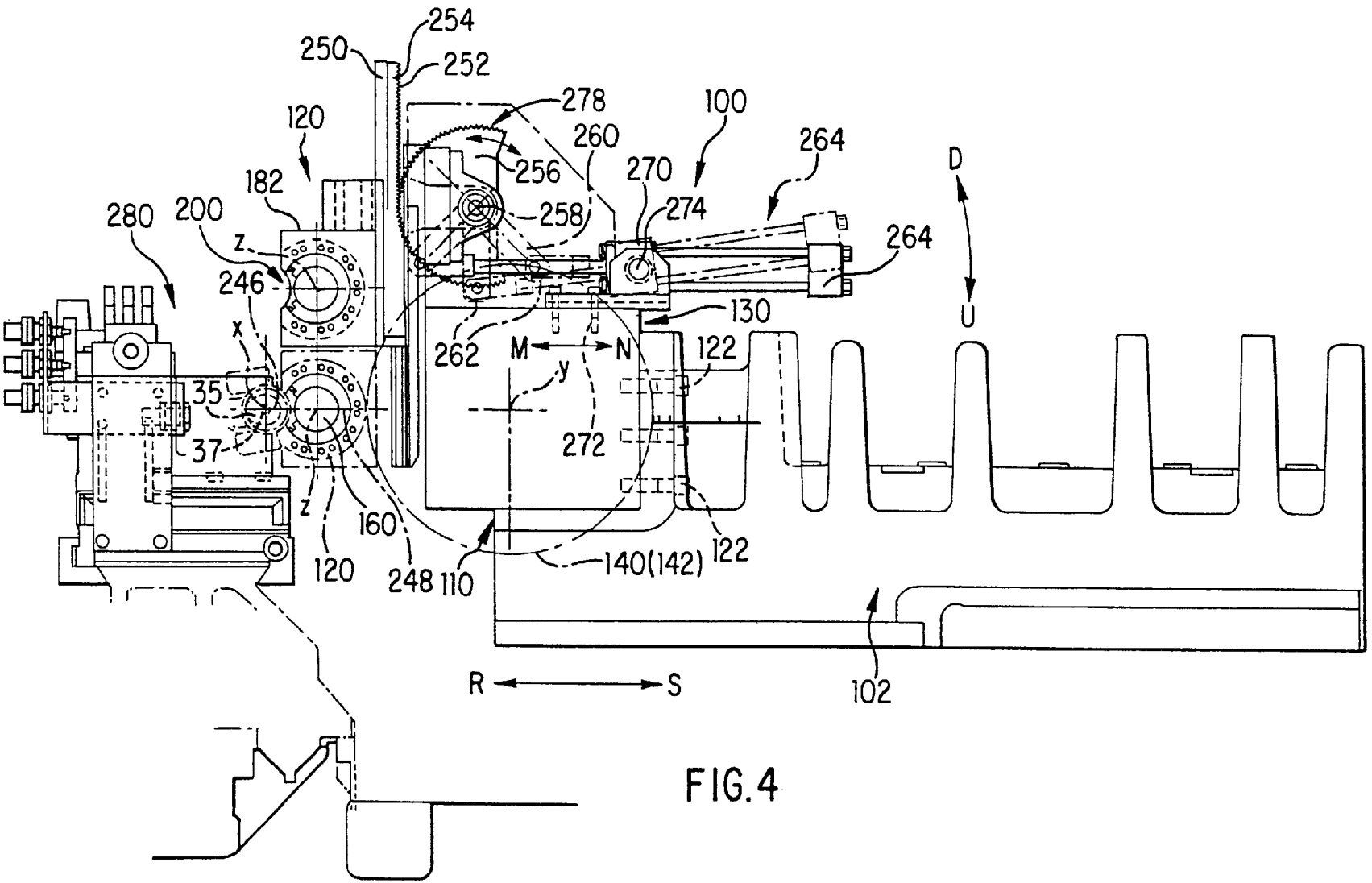
FIG. 4 is a side elevation of the mechanisms of FIG. 3 with parts cut away and removed to better show details thereto.

With reference to FIGS. 3 and 4 there is generally shown at 100 wheel tool head assembly incorporating the instant invention. Assembly 100 is carried by a tool carriage or tool head 102 of conventional configuration and construction (such as tool or wheel head carriage 33 of prior art FIG. 1) which, in turn is carried by a machine tool base (not shown) such as base 15 of FIG. 1. A conventional wheel head drive mechanism is disposed between the machine tool base 15 and wheel head 102 to facilitate incremental movement of wheel head 102 in directions of arrows R and S (FIGS. 1,3 and 4) under CNC control as from a control or computer (not shown) similar to that shown at 89 in FIG. 1.

Wheel head assembly 100 (FIGS. 3 and 4) includes a first or primary wheel spindle assembly 110 and a second or secondary wheel spindle 120 (FIGS. 3, 4 and 5) each of which is carried by wheel head 102 (FIGS. 3 and 4). Spindle assembly 110 is shown as being fixedly secured to wheel head 102 by conventional means such as threaded members 122 or the like. If desired spindle assembly 110 could itself be mounted to a wheel head or carriage (not shown) which could, in turn, be mounted to wheel head 102 for movement in directions of arrows A–B (FIGS. 1 and 3) by conventional means and with such movements CNC controlled. Suitable and conventional guides (not shown) are provided between wheel head 102 and the machine base or frame 15 to facilitate and guide the afore described movements of wheel head 102. Similar guides (not shown) could also be provided between spindle assembly 110 and a movable carriage for same (not shown) disposed between spindle assembly 110 and wheel head 102.

First or primary spindle assembly 110 includes a spindle motor 130 with a spindle shaft 132 (FIG. 3) extending therefrom through a spindle casing 134 and terminating at a nose end 136. A pair of grinding wheels 140, 142 are secured by conventional means, such as bolts 146, a wheel center assembly consisting of a wheel center 148*a*, a spacer 148*b*, and a wheel center ring 148*c* at nose end 136 of spindle shaft 132.

Spindle assembly 110 is substantially of conventional construction with its bearings (not shown) and other constituent components (also not shown) arranged in motor 130 and casings 134, and with control of the rotation of spindle shaft 132 and grinding wheels 140, 142 under computer CNC control. Spindle assembly 110 may just as well be a motorized spindle incorporating its motor drive as part of the spindle within casing 134 instead of being attached to the end of same.

While spindle assembly 110 is shown as including a pair of grinding wheels 140, 142 it may also utilize a single grinding wheel. When a pair of grinding wheels 140, 142 are, in fact, utilized for spindle assembly 110, the spacing "d" between the wheels is selected to correspond to the spacing "e" between cam lobes 35 (FIGS. 3 and 5) of the cam shaft 37 to be ground. The thickness "t" of grinding wheels 140, 142 is also selected to correspond to the thickness or width "w" of cam lobes 35. It is understood when two grinding wheels 140, 142 are to be utilized by a single spindle assembly 110 to simultaneously grind a pair of adjacent cam lobes that the peripheral contour to which such cam lobes are to be ground and the respective phase angles for such cam lobes must be identical. Grinding wheels 140, 142 may be of conventional or special construction and could include CBN.

Figure 2:
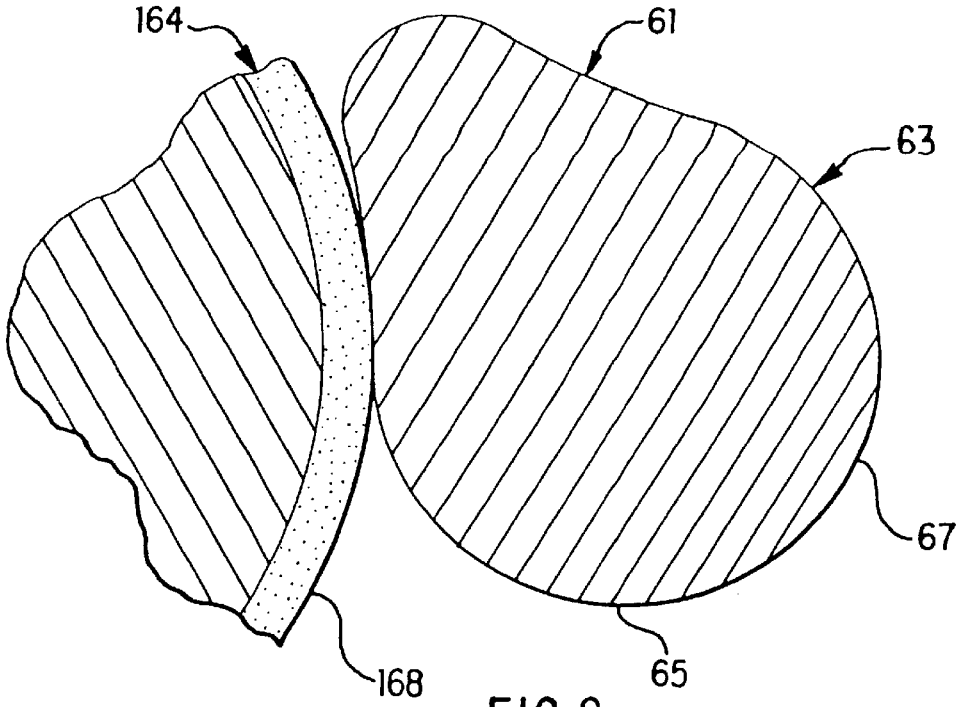
FIG. 2 is a section view of an example of a cam lobe with both convex and concave (re-entrant) cam surface portions.
Figure 6:
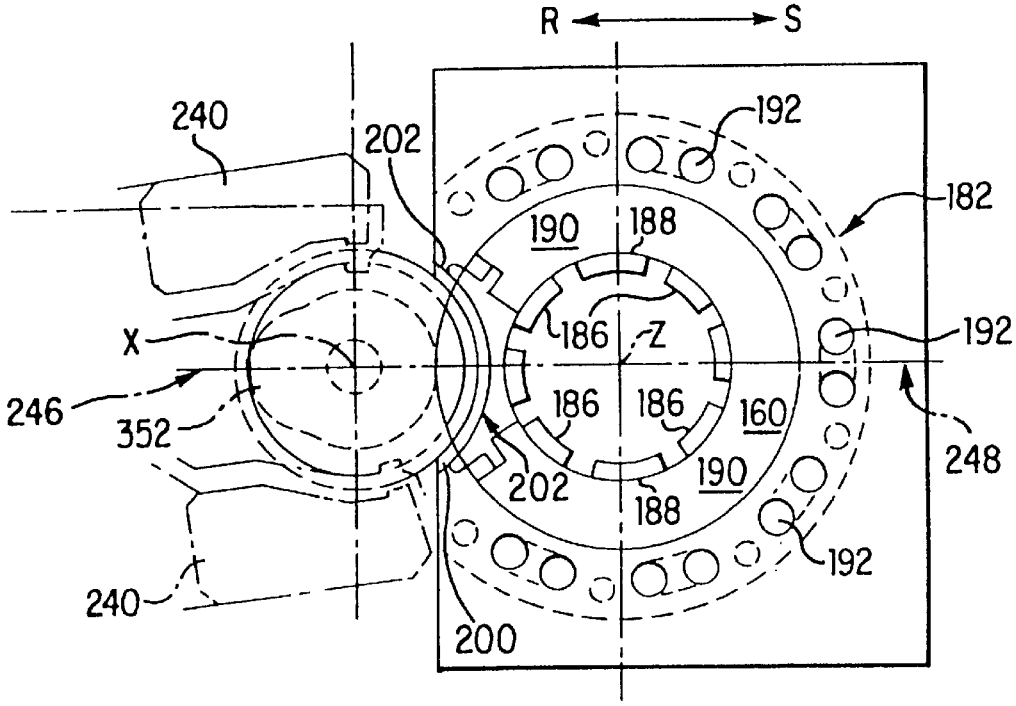
FIG. 6 is a section along line 6—6 of FIG. 3 with parts removed and enlarged to better show details thereof.

Second or secondary spindle assembly 120 may be considered to be a modified motorized spindle and includes a rotatable spindle 160 (FIGS. 5 and 6) that includes a nose end 162 (FIGS. 3 and 5) to which a grinding wheel 164 is secured by bolts 166 (FIG. 5) or the like. It should be noted that grinding wheel 164 is of relatively small diameter when compared to the diameter of grinding wheels 140, 142. Grinding wheel 164 may otherwise be of conventional construction but preferably will include a grinding rim 168 (FIGS. 2 and 5) of CBN or comparable grinding material.

Bearings 176 (FIG. 5), preferably of the hydrostatic type, support rotatable spindle 160 for rotation about a stationary spindle 180 and within a casing or housing 182. A number of permanent magnets 186 (FIGS. 5 and 6) are secured to the outer surface of rotatable spindle 160 by suitable adhesive, or the like, in spaced relationship about the circumference of spindle 160. Magnets 186 may be secured to the surface of spindle 160 or imbedded into that surface. Magnets 186 extend the length of spindle 160 co-extensive with the length of stator 190. While magnets 186 have been shown in FIG. 6 with spaces between same magnets 186 may also be provided in sufficient numbers to cover spindle 160 proximate stator 190. A relative thin cover 188 of aluminum, or similar suitable substance cover magnets 186.

Permanent magnets 186 and spindle 160 are disposed for coaction with an electric motor stator 190 (FIGS. 5 and 6) which substantially surrounds spindle 160 as will be hereinafter explained. Spindle 160 and stator 190 coact as a permanent magnet electric motor to induce rotation of spindle or rotor 160 within stator 190 and therefore to rotate grinding wheel 164 for grinding purposes.

Casing or housing 182 encloses stator 190 as well as stationary spindle 180, rotatable spindle (or rotor) 160 and other associated components. Coolant channels 192 extend through casing 182 to provide coolant fluid for spindle assembly 120. Hydrostatic fluid channels and other openings are provided into and through stationary spindle 180 to facilitate providing hydrostatic fluid to bearings 176 and any other required places. Similarly suitable electric cables and conduits are provided to and within spindle assembly 120 to provide appropriate electricity to spindle assembly 120 and stator 190 thereof to effect operations thereof. Additional fluid conduits are provided to route coolant to channels 192. Control over the operation of second spindle assembly 120 is provided by CNC computer (not shown) in substantially conventional manners.

Figure 5:
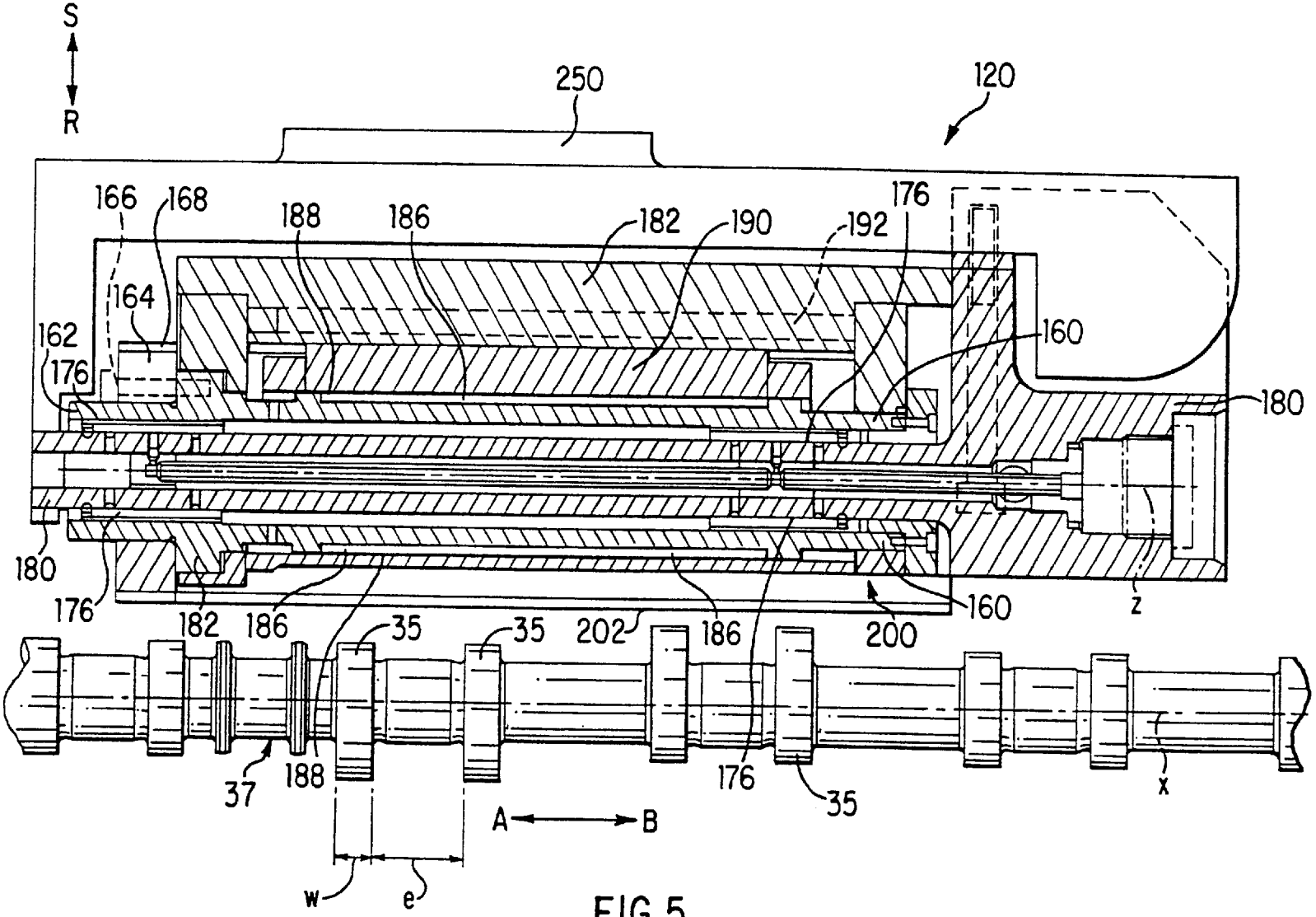
FIG. 5 is an enlarged section view of one of the tool spindles of FIGS. 3 and 4.

It is important to note that the diameter, or alternatively the width, of casing 182 of spindle assembly 120 is larger (greater) than the diameter of small grinding wheel 164 (FIGS. 3 and 5). To enable grinding wheel 164 to properly grind the deepest concave (re-entrant) surface 61 (FIG. 2) of cam lobe 65 the axis of rotation "Z" (FIG. 6) of grinding wheel 164, and of its spindle assembly 120, must be moved towards the axis of rotation "X" of the cam shaft 37 being ground sufficiently to move the surface of small grinding wheel 164 against the surface of cam lobe 35 and to effect grinding of the entire surface 61 of cam lobe 35.

An opening 200 (FIGS. 4 and 6) extends into second spindle assembly 120 and is provided for same by either removing a sector of stator 190 and casings 182 or by not including or providing such to begin with. Opening 200 extends substantially the length of rotating spindle 160 and is otherwise sized and configured to receive the peripheries of cam lobes 35, that are not being ground by small grinding wheel 164 and thus permit movement of grinding wheel 164 towards camshaft 37 sufficiently to facilitate grinding of a particular cam lobe 35 by grinding wheel 164 as will be hereinafter explained in greater detail. A cover 202, of suitable plastic or the like is disposed within opening 200 to close off an inner portion of opening 200 at a location appropriate to protect rotor 160, stator 190, and other components from dirt, grinding and lubrication fluids, swarf and other contamination generated and encountered where components are ground into shapes, while at the same time facilitating the grinding of cam lobes 35 as will be hereinafter explained in greater detail.

Thus, when grinding wheel 164 is grinding a cam lobe 35 towards the left of cam shaft 37, such as cam lobe 35*a* (FIG. 3), a number of adjacent cam lobes (35*b*, 35*c*, 35*d*, 35*e* and 35*f*) will be received in space 200 (FIGS. 3 and 6) as second spindle assembly 120 is moved in the direction of arrow R so that grinding wheel 164 can move sufficiently, in the direction of arrow R, to grind to the bottom of concave portions 61 of cam lobes 65 as well as base circle 67 (FIG. 2) thereof and other portions of cam surface 61.

Figure 1:
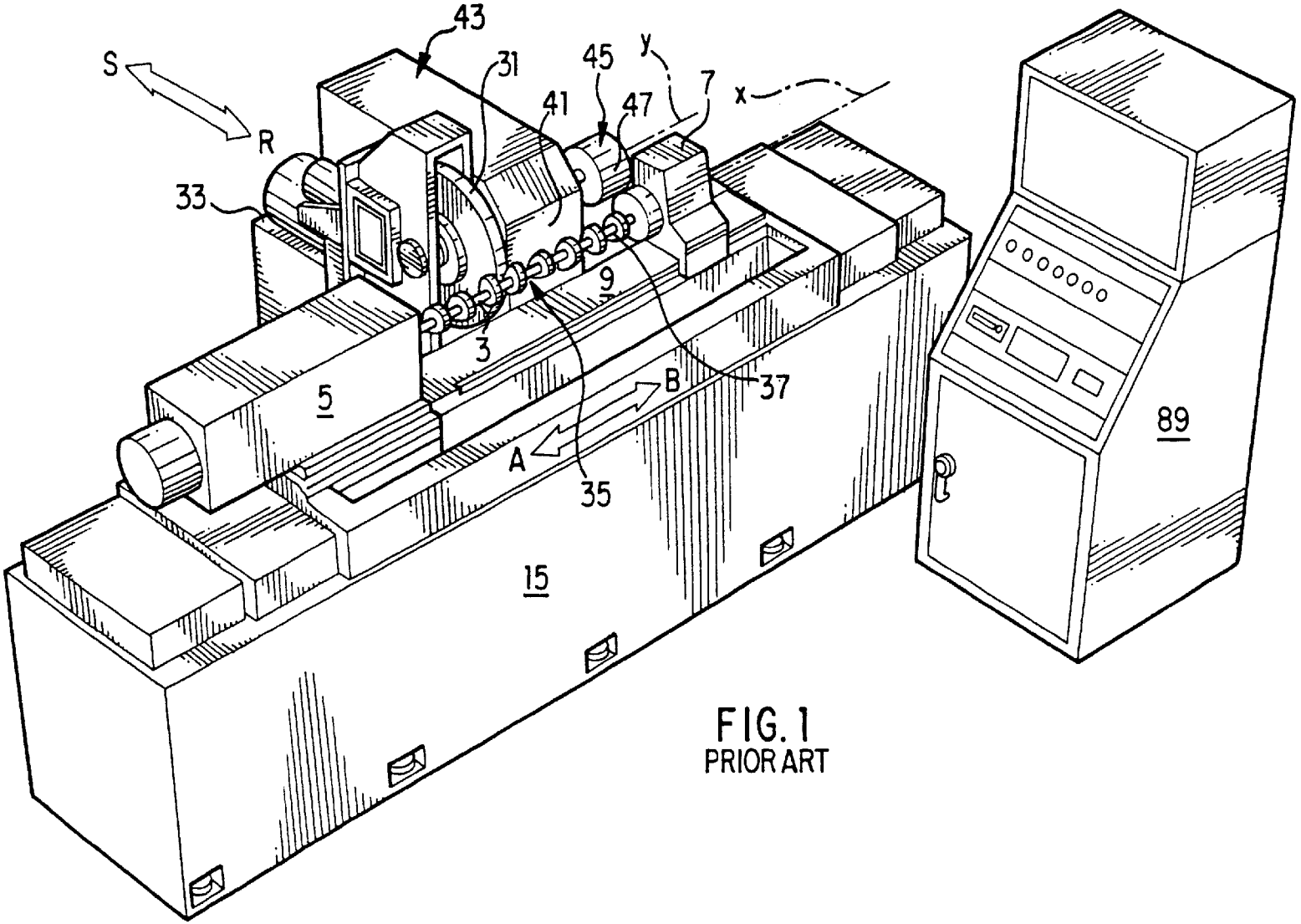
FIG. 1 PRIOR ART
FIG. 1 is a perspective schematic showing of a prior art machine tool in the configuration of a grinding machine.

A first end 208 of cam shaft 37 is clamped for rotation in a substantially conventional and rotatably driven head stock assembly 210 (similar to head stock assembly 5 of FIG. 1). The other end 212 of cam shaft 37 is positioned for coaction and rotation with respect to a center 214 of a footstock assembly 216. Headstock assembly 210 is fixedly secured to a work carriage 230 [similar to work carriage 9 (FIG. 1)] that is, in turn, mounted on base 15 for movement in directions of arrows A and B.

Footstock assembly 216 (FIG. 3) is also carried by work carriage 230 for movement in directions of arrows A and B. Footstock assembly 216 may also be moveable in the directions of arrows A and B, but with respect to work carriage 230, in order to position center 214 according to the length of the cam shaft (or other work) to be disposed between headstock assembly 210 and footstock assembly 216. It is important to note that center 214 extends towards headstock 210 from a position on the front 218 of footstock assembly 216 at an upper corner 220 of footstock assembly 216 just below top 222 and a side 224 of footstock assembly 216. As such, when work carriage 230 has been moved (in the direction of arrow A) a distance which would place footstock assembly 216 in proximity to an end 234 of second spindle assembly 120 footstock assembly 216 will not interfere with the maximum movement of spindle assembly 120 in the direction or arrow R when grinding wheel 164 is grinding cam lobes 35 or with the movement of primary spindle assembly 110 or secondary spindle assembly 120 when grinding wheels 140, 142 are grinding cam lobes 35.

If desired cam shaft 37, or other work, may also be supported by one or more workrests or worksteadies 240 (shown in phantom in FIG. 6) of conventional construction and operation and which would be removable and conventionally secured to work carriage 230 at appropriate locations along the length of cam shaft 37 to support same, or any other workpiece, while being ground. It might also be possible to utilize workrests 240 instead of footstock assembly 216.

Optimum and efficient grinding of cam lobes 35, or other workpieces, is preferably accomplished when a diameter line through the work being ground, such as diameters line 246 (FIGS. 4 and 6) of cam 35, and a diameter line 248 through the grinding wheel are co-linear. However, when secondary spindle 120 is in position to grind cam lobes 35; as shown for spindle assembly 120 in a lower position (within a dash and line phantom box) in FIG. 4, grinding wheels 140, 142 are blocked, from being moved by tool carriage 102 in the direction of arrow R, close enough to cam lobes 35 to grind same.

Accordingly secondary spindle assembly 120 is fixedly secured to a support plate 250 (FIGS. 3 and 4) by suitable means such as threaded members (not shown). Plate 250, carries a rack 254 disposed for coaction with a pinion gear 256 mounted for rotation at 258. A crankarm 260 is connected at one end to gear 256 and at its other end to an end 262 of a piston and cylinder assembly 264. A plate 270, secured as by threaded members 272 to tool carriage 102, pivotally supports at 274 assembly 264 for rocking motion in the directions of arrows U and D (FIG. 4). A suitable and conventional fluid supply with appropriate controls is provided for the cylinder of assembly 264.

Figure 7:
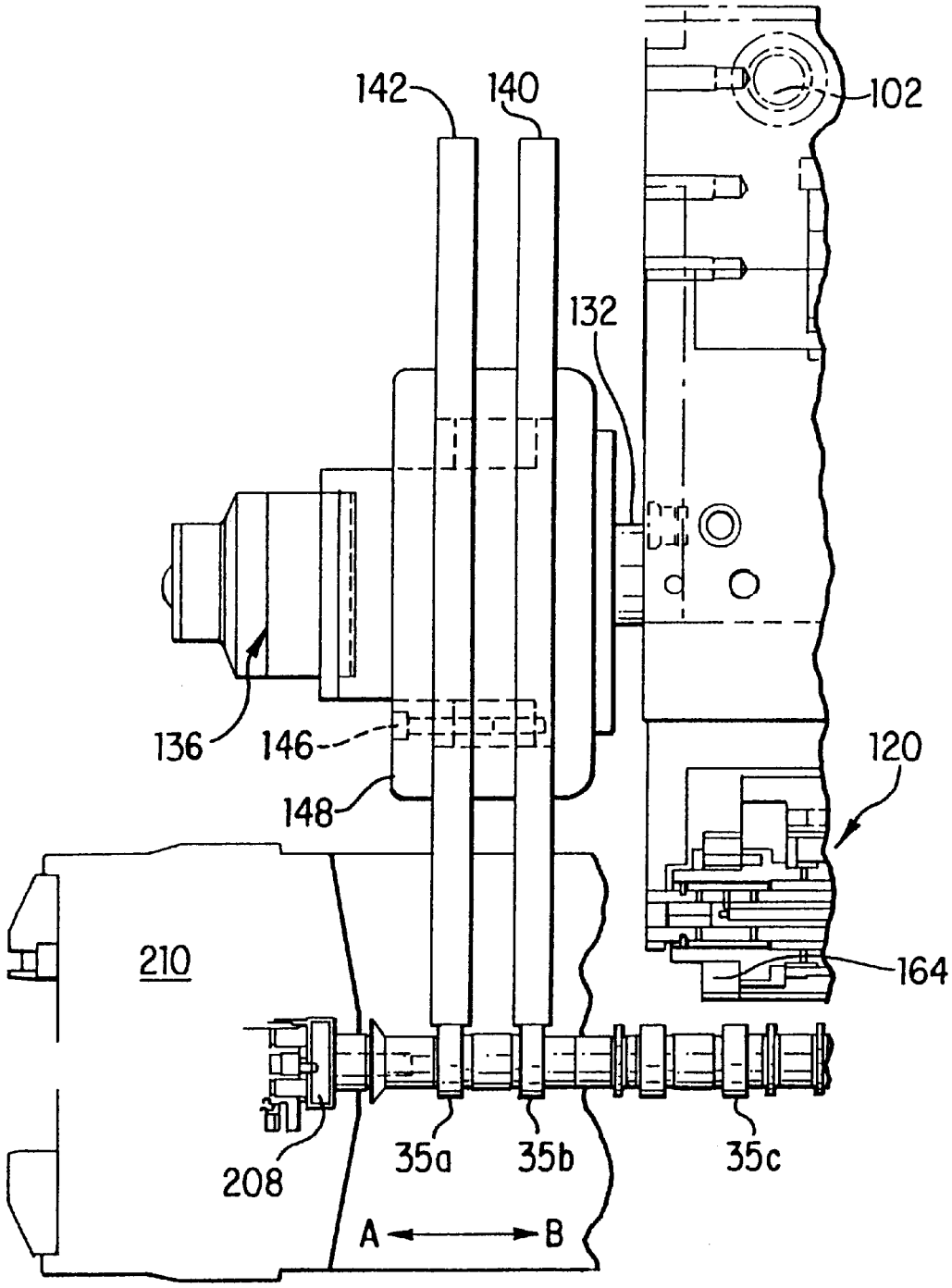
FIG. 7 is a partial plan view similar to that of FIG. 3 but only of the headstock end and with the work carriage moved.

Thus when piston and cylinder assembly 264 is actuated, to extend end 262 in the direction of arrow M (FIG. 4), wheel 256 is rotated clockwise about 258 into its position in FIG. 4 and teeth 278 on wheel 256 coact with the mating teeth on rack 254 to raise rack 254 and support plate 250 into the position shown therefor in FIG. 4. Spindle assembly 120 is moved upwardly into the solid line position therefor as shown in FIG. 4 and wheels 140,142 will be free to move, in the direction of arrow R to engage surfaces of grinding wheels 140, 142 with the surfaces of a pair of adjacent cam lobes such as 35a and 35b (FIG. 7) providing workpiece carriage 230 has been moved in the direction of arrow A to align grinding wheels 140, 142 with cam lobes 35a and 35b respectively.

When grinding wheels 140, 142 move in the direction of arrow R the surfaces thereof can engage surfaces of cam lobes 35 to grind same because secondary spindle assembly 120 (shown in both phantom and in a solid line box) (FIG. 4) has been previously moved from its phantom position to the solid line position and can thereafter move in the direction of arrow R into a space 280 provided for spindle assembly 120 above cam shaft 37, as wells 140, 142 move against cam lobes 35 to grind same.

Operation of piston assembly 264 to retract its end 262 can occur only after primary spindle assembly 110 has been retracted, in the direction of arrow S, a distance sufficient to permit secondary spindle assembly 120 to be lowered into the space between primary spindle assembly 110 and cam shaft 37 (as shown in phantom box in FIG. 4). When piston end 262 is so retracted toothed wheel 256 will be rotated counter clockwise and will coact with toothed rack 254 to lower support plate 250 and move secondary spindle assembly 110 into its position for coaction with cam lobes 35 (as shown in the phantom box in FIG. 4).

Instead of mounting secondary spindle assembly 120 for up and down movement, as described hereinabove, it could instead be mounted to an auxiliary wheelhead (not shown) carried by wheelhead 102 at about the same position shown for spindle assembly 120 in FIG. 3. As such support plate 250, pinion 256, and piston assembly 264 with its mounting 270 could be removed. The auxiliary wheelhead would be carried by wheelhead 102 for movement in the direction of arrows R & S with respect to wheelhead 102 into either an extended work position wherein the small grinding wheel would be disposed to grind cam lobes 35 or into a retracted position permitting the large grinding wheels to grind cam lobes 35. The drive for moving such an auxiliary wheelhead, with respect to wheelhead 102 and towards and away from the workpiece could be similar to the kind of drive utilized to move wheelhead 102 in the directions of arrows R and S with respect to machine frame 15. Since separate drives would be provided for wheelhead 102 and such an auxiliary wheelhead separate CNC controls could also be provided so that grinding wheels 140, 142 could be grinding a pair of cam lobes 35 while the auxiliary grinding wheel is grinding yet another cam lobe. A further modification could be to mount the auxiliary wheelhead for some relatively small amount of movement in the directions of arrows A and B to align the small grinding wheel with a cam lobe 35 while aligning grinding wheels 140, 142 with their respective adjacent cam lobes.

A further alternative mechanism for moving secondary spindle assembly 120 into and out from position of coaction with cam lobes 35 and into a position permitting larger grinding wheels 140, 142 to coact with cam lobes 35, could involve mounting secondary spindle assembly 120 to one or more arms that would in turn mount to housing 134, or otherwise to wheelhead 102. Rotation of such arms could be utilized to move secondary spindle assembly into and away from position wherein the small grinding wheel could coact with cam lobes 35.

One process for grinding cam lobes 35 would be to utilize the larger grinding wheels 140, 142 to rough grind adjacent pairs of cam lobes and thereafter utilize the smaller grinding wheel 164 to grind the concave (re-entrant) surfaces on the rough ground cam lobes 35 and to finish grind each entire cam lobe camming surface.

From the above description, it will then be seen that there has been provided new and novel grinding apparatus incorporating a pair of grinding wheel spindles for rough and finish grinding of surfaces such as those on cam lobes and wherein such surfaces may include both concave and convex contours; as well as a new and novel process to utilize such grinding wheel spindles and a new and novel motorized spindle construction to facilitate such apparatus and process.

It is understood that although there has been shown the preferred embodiments of the invention that various modifications may be made in the details thereof without departing from the spirit as comprehended by the following claims.

What is claimed is:

1. A spindle for a machine tool or the like, comprising:

(a) a spindle shaft having a predetermined length and an outer periphery;

(b) spindle shaft support means mounting said spindle shaft for rotation about a spindle shaft axis of rotation;

(c) tool mounting means disposed proximate an end of said spindle shaft for receiving a machining tool;

(d) a motor stator of predetermined length, surrounding said outer periphery of said spindle shaft and surrounding a predetermined portion of said predetermined length of said spindle shaft;

(e) an opening through said motor stator, said opening extending said predetermined length of said motor stator and extending into said motor stator from an outer surface of said motor stator a predetermined extent towards said outer periphery of said spindle shaft;

(f) said motor stator being energizable and when energized coacting with said spindle shaft to rotate said spindle shaft, and any machining tool carried thereby, about said spindle shaft axis of rotation.

2. The spindle of claim 1 including a casing enclosing said motor stator, said spindle shaft and said spindle shaft support means except for said opening which will also extend through said casing for at least the entire length of said motor stator.

3. The spindle of claim 2 wherein said casing is generally disposed at a predetermined distance from said spindle shaft axis of rotation and said tool mounting means is to mount a machining tool that extends out from said spindle axis of ration by a distance which is less than said predetermined distance.

4. The spindle of claim 3, wherein said tool mounting means mounts a grinding wheel having a radius which is less than said predetermined distance that said casing extends from said spindle axis of rotation.

5. The spindle of claim 4, wherein; said spindle shaft, said motor stator, and said casing are each of substantially circular cross-section in configuration.

6. The spindle of claim 1, wherein a plurality of permanent magnets are secured to said outer periphery of said spindle shaft for a predetermined length of said spindle shaft co-extensive with said motor stator.

7. The spindle of claim 6, wherein said plurality of permanent magnets are disposed about said periphery of said spindle shaft.

8. The spindle of claim 7, wherein said spindle shaft and said motor stator are substantially circular in configuration.

9. The spindle of claim 7, wherein said opening extends through said motor stator and terminates proximate an outer periphery of said spindle shaft.

10. The spindle of claim 9, including a tubular sheath enclosing said permanent magnets upon said spindle shaft.

11. The spindle of claim 10, including a cover disposed in said opening proximates an inner portion thereof and sealing off said permanent magnets, spindle shaft and associated components from external contaminants.

* * * * *